US009611077B2

(12) United States Patent
Kolb et al.

(10) Patent No.: US 9,611,077 B2
(45) Date of Patent: Apr. 4, 2017

(54) MULTI-CHAMBER CONTAINER

(71) Applicant: COLGATE-PALMOLIVE COMPANY, New York, NY (US)

(72) Inventors: Matthew Lee Kolb, Upper Black Eddy, PA (US); John C. Crawford, Mahopac, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/443,592

(22) PCT Filed: Nov. 19, 2012

(86) PCT No.: PCT/US2012/065749

§ 371 (c)(1),
(2) Date: May 18, 2015

(87) PCT Pub. No.: WO2014/077843

PCT Pub. Date: May 22, 2014

(65) Prior Publication Data

US 2015/0298865 A1 Oct. 22, 2015

(51) Int. Cl.
*B65D 35/22* (2006.01)
*B65D 81/32* (2006.01)
(Continued)

(52) U.S. Cl.
CPC ..... *B65D 35/22* (2013.01); *B65D 35/242* (2013.01); *B65D 35/44* (2013.01); *B65D 81/3283* (2013.01)

(58) Field of Classification Search
CPC ..... B65D 35/22; B65D 35/242; B65D 35/44; B65D 81/3283
(Continued)

(56) References Cited

U.S. PATENT DOCUMENTS 1,848,846 A 3/1932 Schell
2,876,935 A 3/1959 Lindberg
(Continued)

FOREIGN PATENT DOCUMENTS

GB 1 180 427 2/1970
JP 1072051 3/1998
(Continued)

OTHER PUBLICATIONS

International Search Report and the Written Opinion of the International Searching Authority issued in International Application PCT/US2012/065749 mailed Jul. 29, 2013.

*Primary Examiner* — Donnell Long

(57) ABSTRACT

Provided is a multi-chamber container for dispensing flowable substances, comprising: a body having: a first storage chamber for storing a first flowable substance, a second storage chamber for storing a second flowable substance, a first outlet zone, a second outlet zone, a first inlet that fluidly connects the first storage chamber with the first outlet zone, a second inlet that fluidly connects the second storage chamber with the second outlet zone, a first apparatus configured, on operation thereof to dispense from the first storage chamber via the first inlet into the first outlet zone a first predetermined volume of the first flowable substance, and a second apparatus configured, on operation thereof to dispense from the second storage chamber via the second inlet into the second outlet zone a second predetermined volume of the second flowable substance; and a closure having a first cavity, a second cavity, and a divider isolating the first cavity from the second cavity, wherein the closure is movable relative to the body between (a) a first position, at which the closure isolates the first and second outlet zones from an exterior of the container, the first outlet zone is in fluid communication with the first cavity of the closure, and the second outlet zone is in fluid communication with the
(Continued)

second cavity of the closure, and (b) a second position, at which the first and second outlet zones are in fluid communication with the exterior of the container.

19 Claims, 4 Drawing Sheets

(51) Int. Cl.
*B65D 35/24* (2006.01)
*B65D 35/44* (2006.01)

(58) Field of Classification Search
USPC .... 222/145.5, 129, 207, 209, 212, 481, 482, 222/518, 545, 559
See application file for complete search history.

(56) References Cited

U.S. PATENT DOCUMENTS 3,319,837 A * 5/1967 Mueller ..... B05B 11/004 215/382
3,323,682 A 6/1967 Creighton et al.
3,347,420 A 10/1967 Donoghue
3,446,403 A * 5/1969 Serio ..... A01M 7/0092 222/158
3,581,940 A 6/1971 Cella
3,729,553 A 4/1973 Gold
4,065,536 A 12/1977 Lucas
4,077,547 A 3/1978 Donoghue
4,279,349 A 7/1981 Aigner
4,372,467 A * 2/1983 Pritchitt ..... G03G 15/104 222/501
4,964,539 A 10/1990 Mueller
5,356,040 A 10/1994 Reggiani
5,482,170 A 1/1996 Semersky
5,573,143 A 11/1996 Deardurff et al.
5,593,065 A 1/1997 Harrold
5,636,765 A 6/1997 Dejonge
5,740,947 A 4/1998 Flaig et al.
5,899,360 A 5/1999 Mack
5,975,364 A 11/1999 Kaufman

FOREIGN PATENT DOCUMENTS

JP 2003128109 5/2003
TW 201433508 9/2014
TW 201438970 10/2014
WO WO 2011/056173 5/2011
WO WO 2012/082138 6/2012

* cited by examiner

MULTI-CHAMBER CONTAINER

CROSS-REFERENCE TO RELATED PATENT APPLICATIONS

This application is a U.S. national stage application under 35 U.S.C. §371 of PCT Application No. PCT/US2012/65749, filed Nov. 19, 2012, the entirety of which is incorporated herein by reference.

FIELD OF THE INVENTION

The present invention relates to a multi-chamber container. The multiple chambers of the container may store respective flowable substances, for example respective oral care products such as mouthwashes or respective components of a mouthwash.

BACKGROUND OF THE INVENTION

A multi-chamber container is a container having more than one chamber for storing respective substances out of contact with one another. It may be desirable to keep the respective substances out of contact with one another during storage of the respective substances, for example if the substances might react or deteriorate over time should they be allow to mix.

Over the years, efforts have been made to improve the design of multi-chamber containers to try to prevent, during dispensing of two substances from respective chambers of the container, a first of the substances from a first of the chambers flowing into a second of the chambers holding a second of the substances causing inadvertent mixing of the substances. For example, it is known to provide a two-compartment container with two discharge openings, each leading to a respective one of the compartments, and rib members between the discharge openings to hinder a substance from the first compartment flowing into the second compartment during dispensing of the substances.

Despite these efforts, a need still exists for multi-chamber container with a structure that better prevents, during dispensing of two substances from respective chambers of the container, a first of the substances stored in a first of the chambers flowing into a second of the chambers storing a second of the substances.

SUMMARY OF THE INVENTION

A first aspect of the present invention provides a multi-chamber container for dispensing flowable substances, comprising: a body having: a first storage chamber for storing a first flowable substance, a second storage chamber for storing a second flowable substance, a first outlet zone, a second outlet zone, a first inlet that fluidly connects the first storage chamber with the first outlet zone, a second inlet that fluidly connects the second storage chamber with the second outlet zone, a first apparatus configured, on operation thereof, to dispense from the first storage chamber via the first inlet into the first outlet zone a first predetermined volume of the first flowable substance, and a second apparatus configured, on operation thereof, to dispense from the second storage chamber via the second inlet into the second outlet zone a second predetermined volume of the second flowable substance; and a closure having a first cavity, a second cavity, and a divider isolating the first cavity from the second cavity, wherein the closure is movable relative to the body between (a) a first position, at which the closure isolates the first and second outlet zones from an exterior of the container, the first outlet zone is in fluid communication with the first cavity of the closure, and the second outlet zone is in fluid communication with the second cavity of the closure, and (b) a second position, at which the first and second outlet zones are in fluid communication with the exterior of the container.

Preferably, the container comprises a first member movable between a closed position, at which the first member seals the first inlet to isolate the first storage chamber from the first outlet zone, and an open position, at which the first storage chamber is in fluid communication with the first outlet zone. Preferably, the container comprises a second member movable between a closed position, at which the second member seals the second inlet to isolate the second storage chamber from the second outlet zone, and an open position, at which the second storage chamber is in fluid communication with the second outlet zone.

Preferably, when the closure is at the first position, the first and second members are prevented from moving to their respective closed positions. Preferably, when the closure is at the first position, the closure contacts the first and second members to prevent the first and second members from moving to their respective closed positions. Preferably, when the closure is at the second position, the first and second members are movable to their respective closed positions. The first and second members may be biased to their respective closed positions. Optionally, the first member comprises a first piston disposed in the first inlet and the second member comprises a second piston disposed in the second inlet.

Preferably, when the closure is at the first position, the closure is spaced from the first and second inlets.

Preferably, the first outlet zone is a first portion of a mixing chamber of the body and the second outlet zone is a second portion of the mixing chamber. Optionally, when the closure is at the first position, the divider isolates the first portion of the mixing chamber from the second portion of the mixing chamber. Optionally, when the closure is at the second position, the first portion of the mixing chamber is in fluid communication with the second portion of the mixing chamber.

Optionally, a wall defining the mixing chamber has a groove for receiving a portion of the divider when the closure is at the first position.

Optionally, when the closure is at the second position, the mixing chamber is free of the divider.

Optionally, each of the first and second inlets comprises a protrusion protruding into a respective one of the first and second outlet zones, the protrusion having an internal passage in fluid communication with a respective one of the first and second storage chambers, which passage opens into the respective one of the first and second outlet zones at an opening formed in the protrusion.

Optionally, when the closure is at the second position, the closure is attached to the body. Alternatively, when the closure is at the second position, the closure is detached from the body.

The container may comprise a lock for locking the closure at the first position.

Optionally, the first and second storage chambers are defined by respective first and second vessels that are squeezable by a user to cause the first flowable substance to flow into the first outlet zone and the second flowable substance to flow into the second outlet zone. Alternatively, the first and second storage chambers are made from a hard, preferably rigid, material.

Preferably, the first and second storage chambers are defined by respective non-unitary first and second vessels. Preferably, the first and second outlet zones are defined by a third vessel that is non-unitary with the first and second vessels and is attached to the first and second vessels.

Optionally, the container comprises a base that is non-unitary with the first and second vessels, wherein the first and second vessels are disposed between the third vessel and the base. Preferably, the first and second vessels are disposed in parallel between the third vessel and the base.

Preferably, the first cavity has a first volume equal to or greater than the first predetermined volume, and the second cavity has a second volume equal to or greater than the second predetermined volume.

DETAILED DESCRIPTION OF THE PREFERRED EMBODIMENTS

Figure 1:
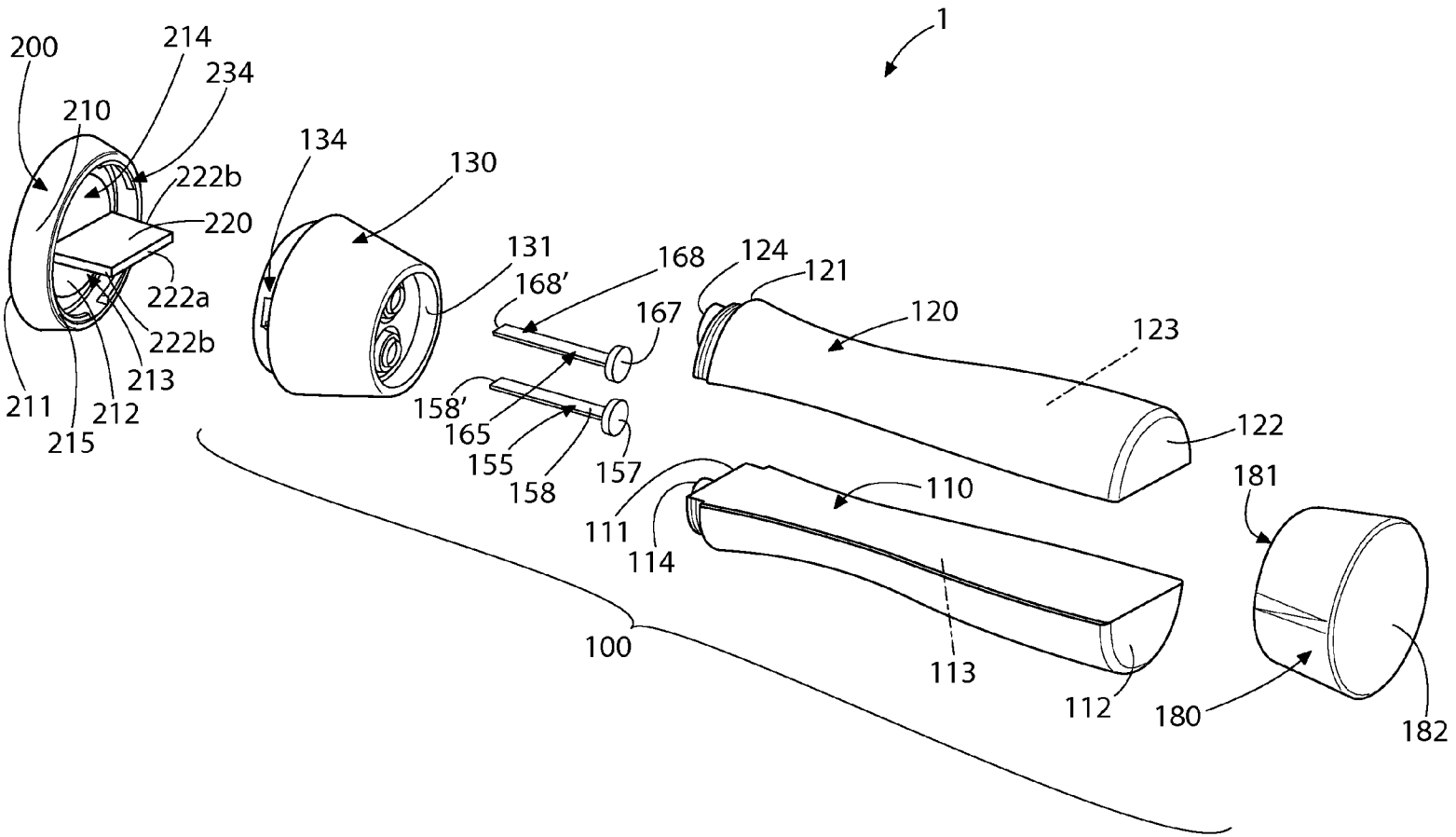
FIG. 1 is an exploded view of components of a multi-chamber container according to an embodiment of the present invention.

The following description of the preferred embodiments is merely exemplary in nature and is in no way intended to limit the invention, its application, or uses. The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

A multi-chamber container for dispensing flowable substances and according to a first embodiment of the present invention will be described with reference to FIGS. 1 to 4.

The container 1 comprises a body 100 and a closure 200. The body 100 comprises first and second storage chambers 113, 123 each for storing a flowable substance, or each storing a flowable substance, such as a liquid or a paste. The first and second storage chambers 113, 123 are defined by respective first and second vessels 110, 120 that have respective orifices 114, 124 at a first small end 111, 121 thereof. Each of the first and second vessels 110, 120 has a second small end 112, 122 at an end opposite to the first small end 111, 121 thereof. Each of the first and second vessels 110, 120 is elongate between its first and second small ends. The first and second vessels 110, 120 are made from a hard, preferably rigid, material. However, in a variation to this embodiment, the first and second vessels 110, 120 may be made from a flexible, preferably resilient, material, whereby each of the first and second vessels 110, 120 is squeezable by a user to cause the first and second flowable substances to flow out from the respective first and second storage chambers 113, 123 through the respective orifices 114, 124.

The first and second vessels 110, 120 are non-unitary. That is, the first and second vessels 110, 120 are not integrally formed together, but instead are separate components that are connected together during assembly of the container 1. In a variation to the illustrated embodiment, the first and second storage chambers 113, 123 may be defined as separate compartments in a single, unitary vessel.

The container 1 also comprises a base 180 that is non-unitary with the first and second vessels 110, 120. The base 180 has an exterior base end 182, and an interior hollow 181 for receiving the second small ends 112, 122 of the first and second vessels 110, 120.

The body 100 further comprises a third vessel 130 that is non-unitary with the first and second vessels 110, 120 and the base 180. The third vessel 130 is attached to the first and second vessels 110, 120 during assembly of the container 1. More specifically, during assembly of the multi-chamber container 1, the first and second vessels 110, 120 are brought into contact with each other, their respective first small ends 111, 121 and orifices 114, 124 are inserted into a receiving hole 131 formed in a first side of the third vessel 130, and their respective second small ends 112, 122 are inserted into the hollow 181 formed in the base 180. Then, the respective first small ends 111, 121 of the first and second vessels 110, 120 are fixed to the third vessel 130, such as by adherence using adhesive or by sonic welding the third vessel 130 to the first and second vessels 110, 120, and the respective second small ends 112, 122 of the first and second vessels 110, 120 are fixed to the base 180, such as by adherence using adhesive or by sonic welding the base 180 to the first and second vessels 110, 120. Accordingly, in the assembled container 1, the first and second storage chambers 113, 123, indeed the first and second vessels 110, 120, are disposed in parallel between the base 180 and the third vessel 130.

Figure 3:
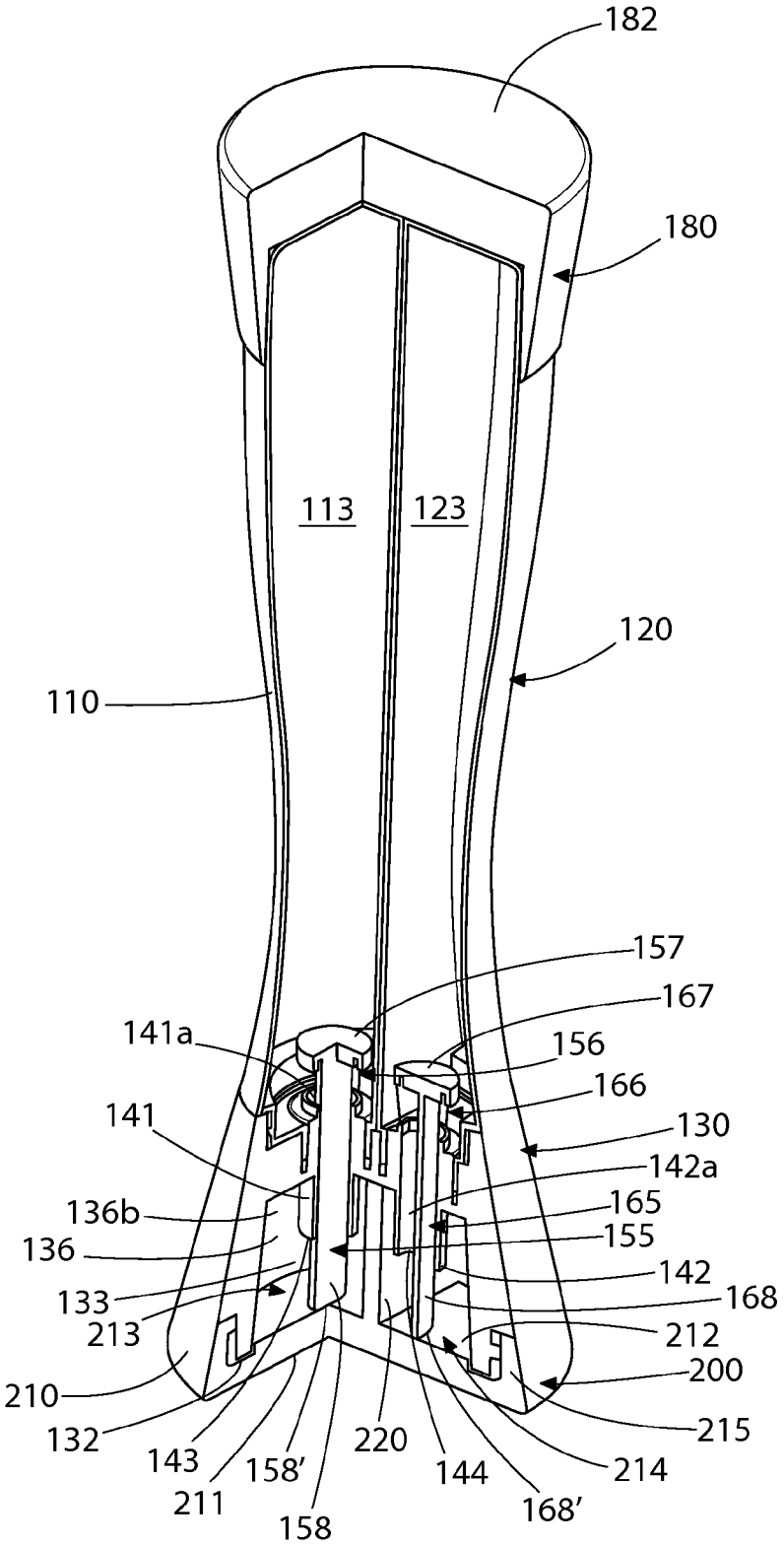
FIG. 3 is a cross sectional view of the multi-chamber container of FIG. 2, shown with the closure of the container at its first, closed position relative to the body of the container.
Figure 4:
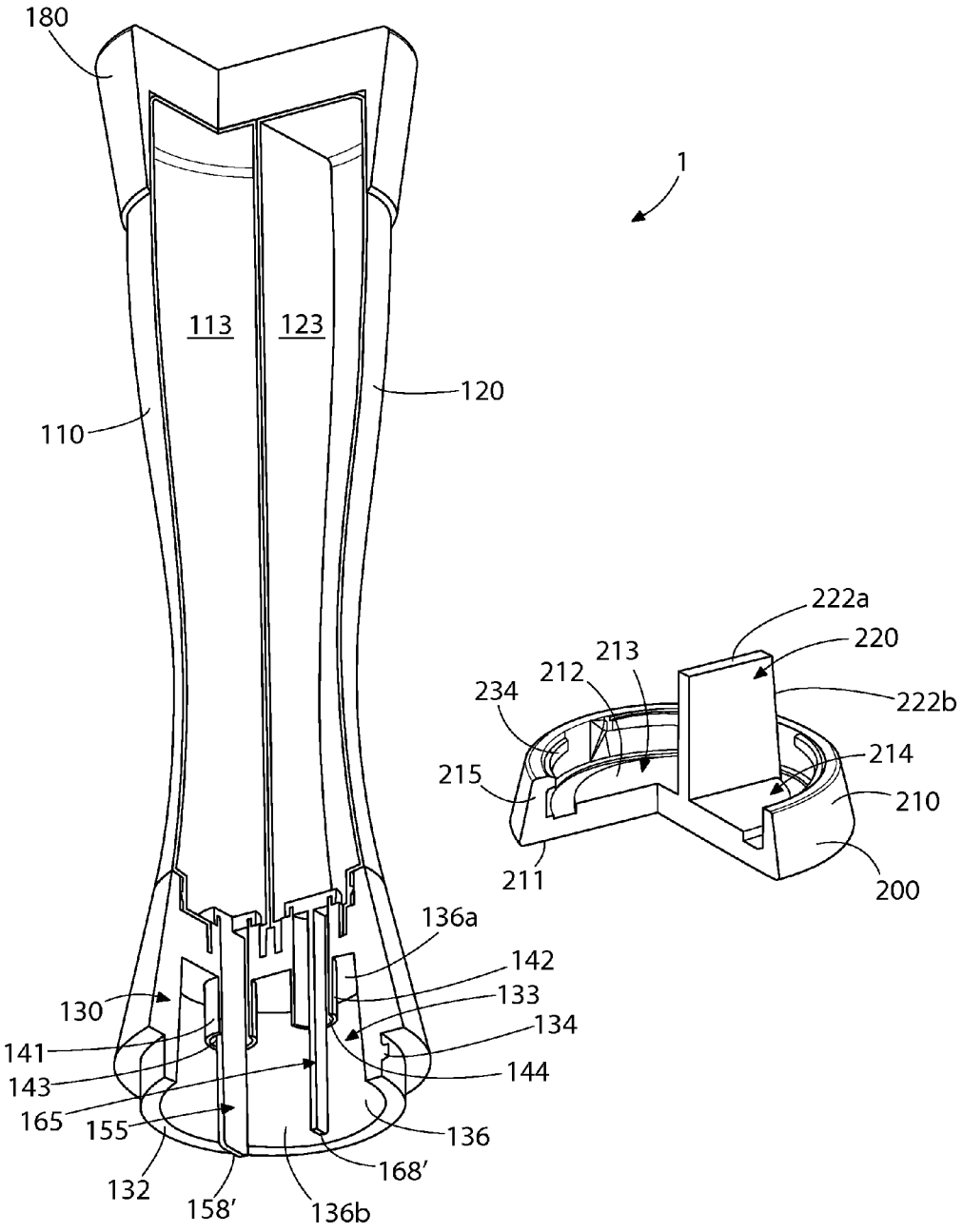
FIG. 4 is a cross sectional view of the multi-chamber container of FIG. 2, shown with the closure of the container at its second, open position relative to the body of the container.

As best shown in FIGS. 3 and 4, the third vessel 130 has a wall 136 defining a mixing chamber 133. In this embodiment, the wall 136 defining the mixing chamber 133 comprises a circular sub-wall **136*a* and a cylindrical sub-wall 136*b* depending from an edge of the circular sub-wall 136*a*. However, in variations to this embodiment, the wall 136 may take a different shape. Indeed, in some embodiments, the wall 136 may be comprised of a set of polygonal sub-walls that together define the mixing chamber 133, or the wall 136 may be substantially hemispherical. The mixing chamber 133 is sized to receive a divider 220 of the closure 200 when the closure 200 is at a first, closed position relative to the body 100, as will be discussed in more detail below. The mixing chamber 133 can be considered to comprise a first portion 133***a* (or first outlet zone 133*a*) and a second portion 133*b* (or second outlet zone 133*b*), with the first and second portions 133*a*, 133*b* together forming the mixing chamber 133. As discussed in more detail below, the divider 220 of the closure 200 has edges 222*a*, 222*b* that cooperate with the sub-walls 136*a*, 1.36*b* of the wall 136 of the third vessel 130 when the closure 200 is at the first, closed position, to isolate the first portion 133*a* of the mixing chamber 133 from the second portion 133*b* of the mixing chamber 133.

In a variation to this embodiment, the wall 136 has a groove 137 for receiving the edges 222*a*, 222*b* of the divider 220 of the closure 200 when the closure 200 is at a first, closed position relative to the body 100.

With reference to both FIGS. 3 and 4, first and second protrusions 141, 142 protrude into the mixing chamber 133. The first protrusion 141 is part of a first inlet that fluidly connects the first storage chamber 113 with the mixing chamber 133, while the second protrusion 142 is part of a second inlet that fluidly connects the second storage chamber 123 with the mixing chamber 133. More specifically, the first inlet fluidly connects the first storage chamber 113 with the first portion 133*a* (or first outlet zone) of the mixing chamber 133, while the second inlet fluidly connects the second storage chamber 123 with the second portion 133*b* of the mixing chamber 133, particularly when the divider 220 isolates the first portion 133*a* from the second portion 133*b*.

The first protrusion 141 has a first internal passage 141*a* in fluid communication with the first storage chamber 113, which first internal passage 141*a* opens into the mixing chamber 133 at a first opening 143 in the first protrusion 141 at a position spaced from the wall 136, while the second protrusion 142 has a second internal passage 142*a* in fluid communication with the second storage chamber 123, which second internal passage 142*a* opens into the mixing chamber 133 at a second opening 144 in the second protrusion 142 at a position spaced from the wall 136.

As shown in FIGS. 1, 3 and 4, the container 1 further comprises a first member 155 disposed in the first internal passage 141*a* of the first protrusion 141 and movable between a closed position, at which the first member 155 seals the first inlet to isolate the first storage chamber 113 from the first outlet zone 133*a*, and an open position, at which the first storage chamber 113 is in fluid communication with the first outlet zone 133*a*. Similarly, the container 1 comprises a second member 165 disposed in the second internal passage 142*a* of the second protrusion 142 and movable between a closed position, at which the second member 165 seals the second inlet to isolate the second storage chamber 123 from the second outlet zone 133*b*, and an open position, at which the second storage chamber 123 is in fluid communication with the second outlet zone 133*b*.

The first member 155 comprises a first piston having a piston head 157 and a blade 158 depending from the piston head 157. The piston head 157 is connected to the first inlet by a rubber band 156 or other resilient element, which biases the first member 155 to its closed position relative to the first inlet. However, when the closure 200 is at its first, closed position (as shown in FIG. 3), the first member 155 is prevented from moving relative to the first inlet to its closed position, because an end 158' of the blade 158 contacts an interior side 212 of the closure 200. Accordingly, when the closure 200 is at its first, closed position, the first member 155 is held at its open position, and the first portion 133*a* of the mixing chamber 133 is maintained in fluid communication with the first storage chamber 113. It will be noted that the blade 158 defines and separates two separate paths in the first internal passage 141*a*, to permit flow of the first flowable substance in a direction from the first storage chamber 113 to the first portion 133*a* of the mixing chamber 133 via one of the paths, and simultaneous flow of air from the first portion 133*a* of the mixing chamber 133 to the first storage chamber 113 via the other of the paths, when the first member 155 is at its open position. However, when the closure 200 is at its second, open position, the first member 155 no longer contacts the closure 200 and so is movable to its closed position to seal the first inlet under the biasing force of the resilient element 156.

Similarly, the second member 165 comprises a second piston having a piston head 167 and a blade 168 depending from the piston head 167. The piston head 167 is connected to the second inlet by a rubber band 166 or other resilient element, which biases the second member 165 to its closed position relative to the second inlet. However, when the closure 200 is at its first, closed position (as shown in FIG. 3), the second member 165 is prevented from moving relative to the second inlet to its closed position, because an end 168' of the blade 168 contacts the interior side 212 of the closure 200. Accordingly, when the closure 200 is at its first, closed position, the second member 165 is held at its open position, and the second portion 133*b* of the mixing chamber 133 is maintained in fluid communication with the second storage chamber 123. It will be noted that the blade 168 defines and separates two separate paths in the second internal passage 142*a*, to permit flow of the second flowable substance in a direction from the second storage chamber 123 to the second portion 133*b* of the mixing chamber 133 via one of the paths, and simultaneous flow of air from the second portion 133*b* of the mixing chamber 133 to the second storage chamber 123 via the other of the paths, when the second member 165 is at its open position. However, when the closure 200 is at its second, open position, the second member 165 no longer contacts the closure 200 and so is movable to its closed position to seal the second inlet under the biasing force of the resilient element 166.

With the closure 200 in the first, closed position, the volume of the first portion 133*a* of the mixing chamber 133 is equal (or substantially equal) to a first predetermined volume of the first flowable substance to be dispensed from the container 1, and the volume of the second portion 133*b* of the mixing chamber 133 is equal (or substantially equal) to a second predetermined volume of the second flowable substance to be dispensed from the container 1. Accordingly, as will be described further below, the container 1 comprises a first apparatus configured, on operation thereof, to dispense from the first storage chamber 113 via the first inlet into the first portion 133*a* (or first outlet zone) of the mixing chamber 133 a first predetermined volume of the first flowable substance, and a second apparatus configured, on operation thereof, to dispense from the second storage chamber 123 via the second inlet into the second portion 133*b* (or second outlet zone) of the mixing chamber 133 a second predetermined volume of the second flowable substance.

As mentioned above, the container 1 further comprises a closure 200. The closure 200 is detachably attached to the body 100 through a screw thread 134 of the third vessel 130 that cooperates with a screw thread 234 of the closure 200. The closure 200 is movable relative to the third vessel 130 and the rest of the body 100.

The closure 200 has a main portion 210 having a first exterior side 211 and the interior side 212, and the divider 220 extending from the interior side 212. The divider 220 has a first straight edge 222*a* that cooperates with the wall 136, more specifically the circular sub-wall 136*a*, of the third vessel 130 when the closure 200 is at the first, closed position, and a pair of second outer edges 222*b* that cooperate with the wall 136, more specifically the cylindrical sub-wall 136*b*, of the third vessel 130 when the closure 200 is at the first, closed position.

The closure 200 is detachable from the body 100 to move the closure 200 from the first, closed position to the second, open position, and the closure 200 comprises a first cavity 213 and a second cavity 214, with the divider 220 separating the first cavity 213 from the second cavity 214. The first cavity 213 is defined by the combination of a first portion of the interior side 212, a first portion of an annular outer wall 215 of the main portion 210, and one side of the divider 220, while the second cavity 214 is defined by the combination of a second portion of the interior side 212, a second portion of the annular outer wall 215, and another side of the divider 220. The first cavity 213 of the closure 200 has a first volume equal to or greater than the first predetermined volume, and the second cavity 214 of the closure 200 has a second volume equal to or greater than the second predetermined volume. When the closure 200 is at the first, closed position, the first portion 133*a* (or first outlet zone) of the mixing chamber 133 is in fluid communication with the first cavity 213 of the closure 200 and the second portion 133*b* (or second outlet zone) of the mixing chamber 133 is in fluid communication with the second cavity 214 of the closure 200.

The closure 200 is movable relative to the body 100 between the first, closed position (see FIGS. 2 and 3) and the second, open position (see FIG. 4). The cooperating screw threads 134, 234 of the third vessel 130 and closure 200 together act as a lock for locking the closure 200 at the first, closed position. When the closure 200 is at the first, closed position, the closure 200 is not movable away from the third vessel 130 without being rotated relative to the third vessel 130. The closure 200 is rotatable relative to the third vessel 130 to disengage the cooperating screw threads 134, 234 to permit movement of the closure 200 relative to the body 100 to the second, open position. Rotation through about 15 to 30 degrees is required to release the lock. Other forms of lock for locking the closure 200 at the first, closed position may instead be provided.

When the closure 200 is at the first, closed position, the main portion 210 of the closure 200 creates a seal with a rim or lip 132 of the third vessel 130 around an opening of the mixing chamber 133 to isolate the mixing chamber 133 from an exterior of the container 1. Moreover, when the closure 200 is at the first, closed position, the divider 220 is disposed in the mixing chamber 133 with the edges 222*a*, 222*b* of the divider 220 contacting the respective sub-walls 136*a*, 136*b*, and the divider 220 isolates the first portion 133*a* of the mixing chamber 133 from the second portion 133*b* of the mixing chamber 133. Furthermore, when the closure 200 is at the first, closed position, the entire closure 200, including the divider 220, is spaced from the first and second inlets, i.e. from the first and second protrusions 141, 142 and their respective openings 143, 144, so as to permit flow of the first flowable substance from the first storage chamber 113 via the opening 143 of the first protrusion 141 into the first portion 133*a* of the mixing chamber 133, and so as to permit flow of the second flowable substance from the second storage chamber 123 via the opening 144 of the second protrusion 142 into the second portion 133*b* of the mixing chamber 133.

On the other hand, when the closure 200 is at the second, open position, the main portion 210 of the closure 200 is separated from the rim or lip 132 of the third vessel 130, and the mixing chamber 133 is in fluid communication with the exterior of the container 1. Moreover, when the closure 200 is at the second, open position, the closure 200 is detached from the third vessel 130 and the rest of the body 100, the mixing chamber 133 is free of the divider 220, and the first portion 133*a* of the mixing chamber 133 is in fluid communication with the second portion 133*b* of the mixing chamber 133.

Figure 2:
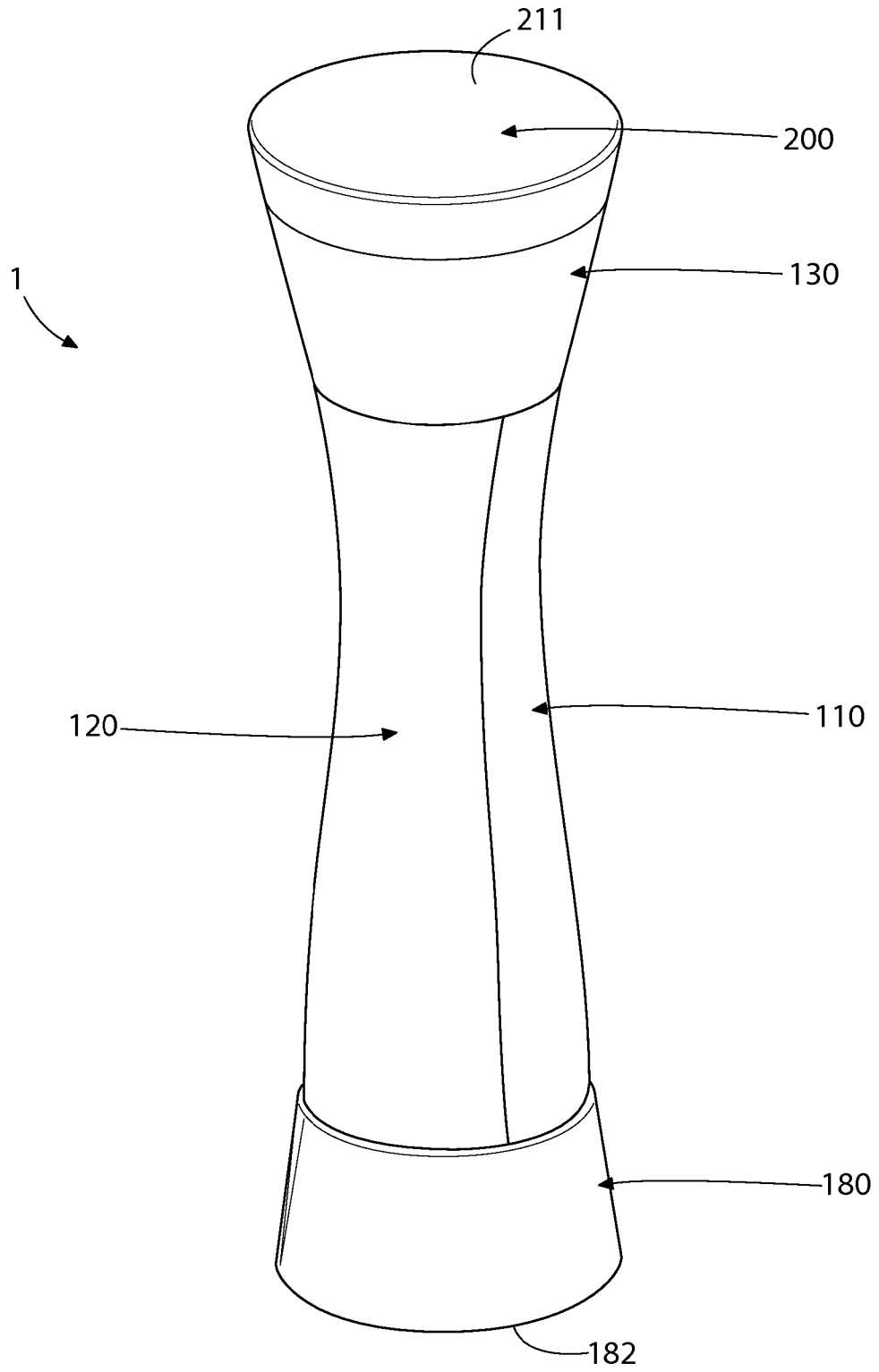
FIG. 2 is a perspective view showing the components of FIG. 1 assembled to form the multi-chamber container according to the embodiment of the present invention, shown with the closure of the container at its first, closed position relative to the body of the container.

When a user wishes to dispense the first and second flowable substances from the container, they first ensure that the closure 200 is at the first, closed position and that the screw threads 134, 234 are mating to engage the lock, as shown in FIG. 2. As discussed above, in this configuration, the first and second members 155, 165 are retained in their open positions.

The user then ensures that the container 1 is in a state with the closure 200 lower than, i.e. below, the base 180 and with the container 1 in a horizontal state, that is with the base end 182 of the container 1 horizontal. This causes the first and second flowable substances to flow out from the respective first and second storage chambers 113, 123 under the influence of gravity, through the respective first and second orifices 114, 124, through the respective first and second internal passages 141*a*, 142*a* and respective first and second openings 143, 144 of the first and second protrusions 141, 142 of the first and second inlets, and into the respective first and second portions 133*a*, 133*b* of the mixing chamber 133, which first and second portions 133*a*, 133*b* of the mixing chamber 133 are isolated from each other by the divider 220 of the closure 200. The volumes of the first and second portions 133*a*, 133*b* of the mixing chamber 133 dictate the respective predetermined volumes of the first and second flowable substances that are dispensed into the first and second portions 133*a*, 133*b*.

While maintaining the container 1 in the horizontal state with the closure 200 lower than, i.e. below, the base 180, the user then rotates the closure 200 relative to the third vessel 130 to release the lock. The user then quickly but steadily moves the closure 200 downwards and away from the third vessel 130, to allow the first and second members 155, 165 to move to their closed positions under the influence of the resilient elements 156, 166, which cuts off the flow of the first and second flowable substances to the first and second portions 133*a*, 133*b* of the mixing chamber 133. Simultaneously, the first predetermined volume of the first flowable substance disposed within the first portion 133*a* of the mixing chamber 133 becomes retained within the first cavity 213 of the closure 200, and the second predetermined volume of the second flowable substance disposed within the second portion 133*b* of the mixing chamber 133 becomes retained within the second cavity 214 of the closure 200. The divider 220 of the closure 200 keeps the first and second flowable substances separate from each other in the closure 200.

While the foregoing description discusses the use of the container 1 in a horizontal state, it is understood that the user may also use the container 1 even if the container 1 is not in a horizontal state, such as using the container 1 when it is slightly tilted with respect to the base 180 of the container 1.

The user then brings a lip or rim of the closure 200 to their lips, tilts the closure 200, and pours the separate first and second predetermined volumes of the respective first and second flowable substances into their mouth. The closure 200 accordingly is useable as a cup. Alternatively, the user may choose to pour the separate first and second predetermined volumes of the respective first and second flowable substances into a separate receptacle or back into the mixing chamber 133 to allow the first and second flowable substances to mix, and then drink the mixed first and second flowable substances from the receptacle or from the mixing chamber 133.

Accordingly, since the first and second flowable substances are kept separate from each other during the dispensing routine, it is prevented, or the risk is minimized, that any of the first flowable substance is allowed to flow towards the second storage chamber 123 via the second opening 144, and that any of the second flowable substance is allowed to flow towards the first storage chamber 113 via the first opening 143.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the scope of the invention should be construed broadly as set forth in the appended claims.

The invention claimed is:

1. A multi-chamber container for dispensing flowable substances, comprising:

a body having:

a first storage chamber for storing a first flowable substance, a second storage chamber for storing a second flowable substance, a mixing chamber comprising a first outlet zone and a second outlet zone, a first inlet that fluidly connects the first storage chamber with the first outlet zone, a second inlet that fluidly connects the second storage chamber with the second outlet zone, a first apparatus configured, on operation thereof, to dispense from the first storage chamber via the first inlet into the first outlet zone a first predetermined volume of the first flowable substance, and a second apparatus configured, on operation thereof, to dispense from the second storage chamber via the second inlet into the second outlet zone a second predetermined volume of the second flowable substance; and a closure comprising a divider, the divider configured to fit within the mixing chamber to define the first and second outlet zones, wherein the closure is movable relative to the body between:

(a) a first position, at which the divider isolates the first and second outlet zones from each other and from an exterior of the container, and at which the closure operates the first and second apparatus such that the first outlet zone is in fluid communication with the first cavity of the closure, and the second outlet zone is in fluid communication with the second cavity of the closure, and (b) a second position, at which the divider does not isolate the first and second outlet zones such that the first and second outlet zones are in fluid communication with each other and the exterior of the container, and at which the closure does not operate the first and second apparatus, such that the first outlet zone is not in fluid communication with the first cavity of the closure, and the second outlet zone is not in fluid communication with the second cavity of the closure.

2. The container of claim 1, comprising:

a first member movable between a closed position, at which the first member seals the first inlet to isolate the first storage chamber from the first outlet zone, and an open position, at which the first storage chamber is in fluid communication with the first outlet zone, and a second member movable between a closed position, at which the second member seals the second inlet to isolate the second storage chamber from the second outlet zone, and an open position, at which the second storage chamber is in fluid communication with the second outlet zone.

3. The container of claim 2, wherein, when the closure is at the first position, the first and second members are prevented from moving to their respective closed positions.

4. The container of claim 3, wherein, when the closure is at the first position, the closure contacts the first and second members to prevent the first and second members from moving to their respective closed positions.

5. The container of claim wherein, when the closure is at the second position, the first and second members are movable to their respective closed positions.

6. The container of claim 2, wherein the first and second members are biased to their respective closed positions.

7. The container of claim 2, wherein the first member comprises a first piston disposed in the first inlet and the second member comprises a second piston disposed in the second inlet.

8. The container of claim wherein, when the closure is at the first position, the closure is spaced from the first and second inlets.

9. The container of claim 1, wherein a wall defining the mixing chamber has a groove for receiving a portion of the divider when the closure is at the first position.

10. The container of claim 1, wherein, when the closure is at the second position, the mixing chamber is at least partially free of the divider.

11. The container of claim 1, wherein each of the first and second inlets comprises a protrusion protruding into a respective one of the first and second outlet zones, the protrusion having an internal passage in fluid communication with a respective one of the first and second storage chambers, which passage opens into the respective one of the first and second outlet zones at an opening formed in the protrusion.

12. The container of claim wherein, when the closure is at the second position, the closure is attached to the body.

13. The container of claim wherein, when the closure is at the second position, the closure is detached from the body.

14. The container of claim 1, comprising a lock for locking the closure at the first position.

15. The container of claim 1, wherein the first and second storage chambers are defined by respective first and second vessels that are squeezable by a user to cause the first flowable substance to flow into the first outlet zone and the second flowable substance to flow into the second outlet zone.

16. The container of claim 1, wherein the first and second storage chambers are defined by respective non-unitary first and second vessels, and the mixing chamber is defined by a third vessel that is non-unitary with the first and second vessels and is attached to the first and second vessels.

17. The container of claim 16, wherein the container comprises a base that is non-unitary with the first and second vessels, wherein the first and second vessels are disposed between the third vessel and the base.

18. The container of claim 17, wherein the first and second vessels are disposed in parallel between the third vessel and the base.

19. The container of claim 1, wherein, when in the first position, the first outlet zone has a first volume equal to or greater than the first predetermined volume, and the second outlet zone has a second volume equal to or greater than the second predetermined volume.

* * * * *